US007862371B1

(12) United States Patent
Johnson

(10) Patent No.: US 7,862,371 B1
(45) Date of Patent: Jan. 4, 2011

(54) LIGHT SOCKET ADAPTER FOR A FAN HOLDING DEVICE

(76) Inventor: Terry David Johnson, 17227 Lakewood Dr., Spirit Lake, IA (US) 51360

( * ) Notice: Subject to any disclaimer, the term of this patent is extended or adjusted under 35 U.S.C. 154(b) by 168 days.

(21) Appl. No.: 12/350,730

(22) Filed: Jan. 8, 2009

Related U.S. Application Data

(60) Provisional application No. 61/020,105, filed on Jan. 9, 2008.

(51) Int. Cl.
*H01R 13/60* (2006.01)

(52) U.S. Cl. ..... 439/530; 362/147

(58) Field of Classification Search ..... 439/530, 439/641–644; 362/147; 454/248, 293; 416/16, 416/131

See application file for complete search history.

(56) References Cited

U.S. PATENT DOCUMENTS

| | | | | |
|---|---|---|---|---|
| 785,004 | A | 3/1905 | Klemm et al. | |
| 1,222,837 | A | 4/1917 | Winslow et al. | |
| 1,747,073 | A * | 2/1930 | Hill | 315/291 |
| 2,434,130 | A * | 1/1948 | Turner | 416/246 |
| D283,156 | S | 3/1986 | Mandelli et al. | |
| 4,882,467 | A | 11/1989 | Dimick | |
| 5,522,704 | A * | 6/1996 | Casteel | 416/246 |
| 6,523,970 | B1 * | 2/2003 | Scales, III | 362/145 |
| 7,513,675 | B2 * | 4/2009 | Mier-Langner et al. | 362/648 |
| 2004/0175281 | A1 * | 9/2004 | Remington | 417/360 |

* cited by examiner

*Primary Examiner*—Edwin A. Leon
*Assistant Examiner*—Vanessa Girardi
(74) *Attorney, Agent, or Firm*—Simmons Perrine Moyer Bergman PLC

(57) ABSTRACT

A system to facilitate installation of a small fan into a ceiling light fixture. A male electrical plug with electrical wire is installed upon the top of a rigid structure. An electrical adapter is inserted into the light fixture's socket in lieu of a light bulb. The conductive prongs of the plug are inserted into a receptacle of the adapter. A leverage arm is created at the bottom of the rigid structure and extends opposite and beyond the vertical centerline of the apparatus to a position where a higher percentage of the weight of the combined appliance and fan is distributed to the side of the centerline opposite the plug putting downward pressure on the outer end of the leverage arm configuration which, in turn, causes the top portion of the apparatus to rotate toward the centerline and to push the prongs inward.

14 Claims, 3 Drawing Sheets

LIGHT SOCKET ADAPTER FOR A FAN HOLDING DEVICE

CROSS REFERENCE TO RELATED APPLICATION

This application claims the benefit of the filing date of the provisional application having Ser. No. 61/020,105 filed on Jan. 9, 2008, by Terry David Johnson, which application is incorporated herein in its entirety by this reference.

FIELD OF THE INVENTION

The present invention generally relates to appliance holders, and more particularly to fan mounting and power provisioning brackets.

BACKGROUND OF THE INVENTION

In the past, ceiling fans have been routinely mounted to electrical boxes installed in a ceiling especially for such fans. However, often the need for air circulation within a room is not fully known until after the room is completed and in use. Flaws in the HVAC system may lead to a later arising need for more ventilation, as well as changes in the use of the room, changes in the number or nature of the users, or it may be just that the users' preferences have changed. All of these reasons and others can result in a need for increased air circulation in a finished room.

However, once a room is finished, the cost to install a new ceiling fan electrical outlet increases dramatically. The wiring is usually not exposed; so expensive to repair holes often are needed to be cut into the walls and or ceiling.

Consequently, there Exists a Need for a Simple and Inexpensive Way to Add a ceiling fan to an existing finished room.

SUMMARY OF THE INVENTION

It is an object of the present invention to provide a quick and relatively inexpensive method and system to add a ceiling-mounted fan into an already finished room.

It is a feature of the present invention to utilize an appliance holding system which hangs a fan beneath a recessed or other ceiling or wall light fixture.

It is another feature of the invention to utilize inexpensive off-the-shelf lamp holder adapters with one or more receptacles.

It is still another feature of the present invention to utilize a drop-down combined fan support bracket and power wire assembly to support and power a small fan.

It is an advantage of the present invention to provide for the ability of installing a small fan in conjunction with an existing light fixture without the need for cutting any holes in a wall or ceiling and without the need for an electrician in the final installation process.

The present invention is an apparatus and method for providing a fan in a finished room which is designed to satisfy the aforementioned needs, provide the previously stated objects, include the above-listed features, and achieve the already articulated advantages. The present invention is carried out in a "ceiling damage and electrician-less system" in a sense that the need to repair a new hole in a ceiling and the need to have an electrician install a new fan has been greatly reduced.

Accordingly, the present invention is a system and method for hanging a fan from an existing female light bulb socket which uses a screw-in lamp holder adapter with an intermediate power receptacle and an end female lamp socket, in combination with an innovative fan hanger and power cord combination.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
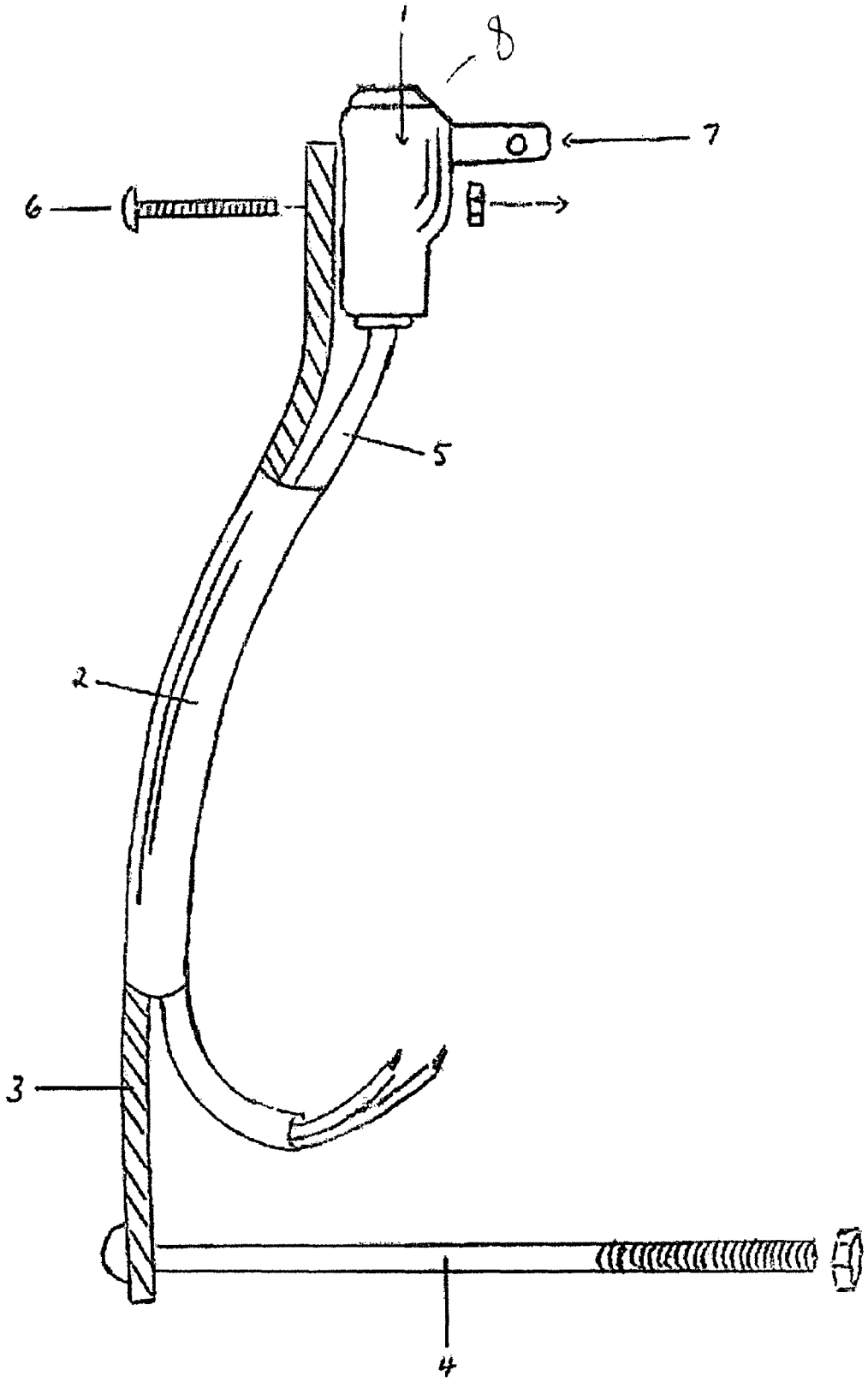
FIG. 1 is a side view of the hanger and power cord assembly of the present invention.

Now referring to the drawings wherein like numerals refer to like matter throughout, and more particularly to FIG. 1, there is shown a fan hanger and power cord assembly of the present invention showing a power cord plug head 1 which may be a standard two-prong 110 V power cord male plug; however, it may be configured with a hole therethrough for receiving the male plug to bracket retainer 6, which is shown as a threaded screw and nut combination. Other suitable substitute means for attaching the hanger bracket 3 to the power cord plug head 1 could be used. Hanger bracket 3 could be a metal or plastic strap that provides sufficient rigidity to hold a small fan during operation. Power cord plug head 1 is shown having a beveled face 8 disposed above the top side of male plug prongs 7. It is not essential that power cord plug head 1 have beveled face 8; however, it is believed that this will help maintain the male plug prongs 7 inside of the receptacle (not shown). Also shown is power cord 5 which takes power from the male plug prongs 7 and delivers it to the fan (not shown) coupled to the opposite end of the power cord 5. An optional protective jacket 2 could be used to hold the power cord 5 next to the hanger bracket 3, and if reflective material is used, it further could protect the power cord from excess external heating. Also shown is leverage arm 4 which may be a threaded bolt and nut combination or other suitable substitute which is used to couple an electrical appliance to the hanger bracket 3. It should be understood that a fan may be bolted to the hanger bracket 3 via leverage arm 4 or any electrical appliance could be made to be connected to the male plug prongs 7 via multiple pieces or a single specially made single part.

Figure 2:
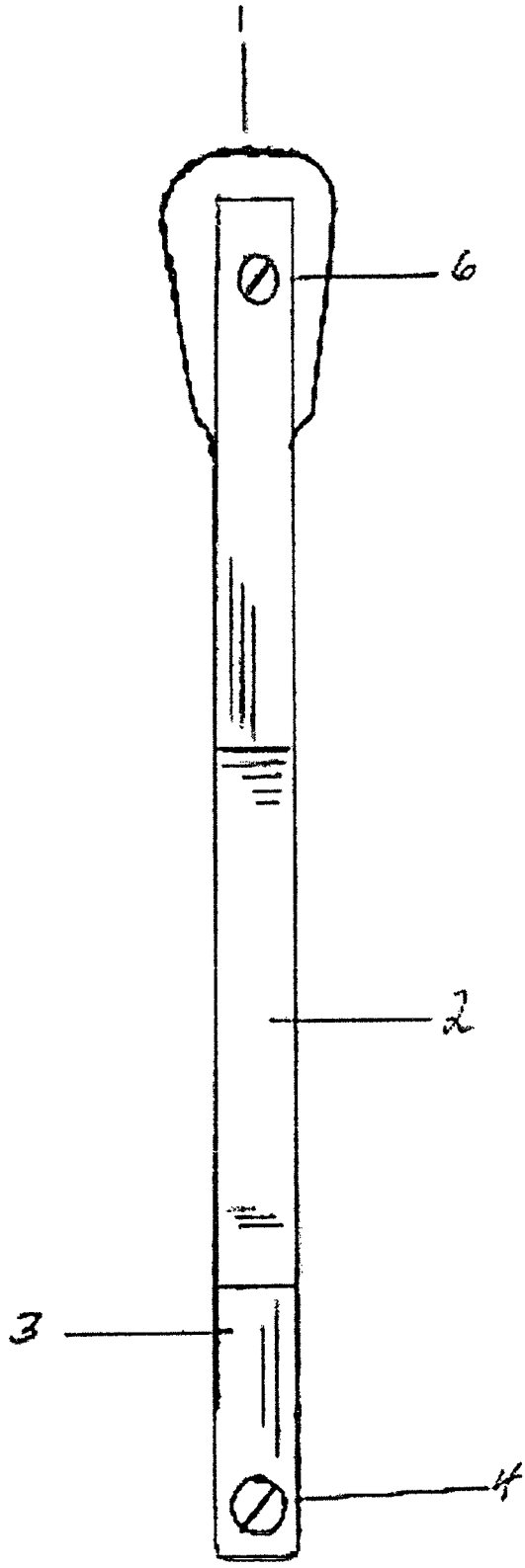
FIG. 2 is an end view of the hanger and power cord assembly of FIG. 1.

Now referring to FIG. 2, there is shown an end view of the hanger bracket 3 shown in FIG. 1.

Figure 3:
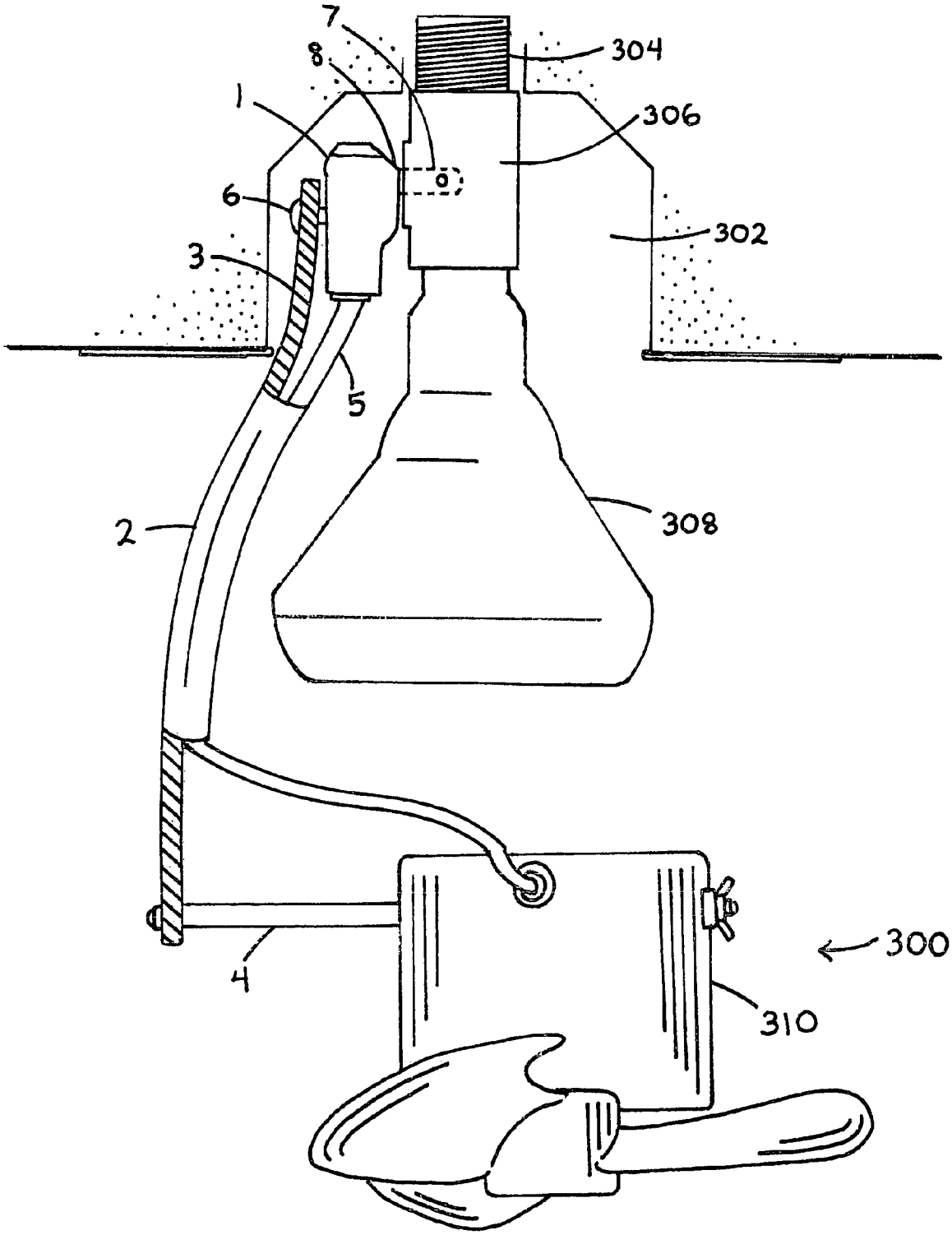
FIG. 3 is a partial cross-section view of the can ceiling light, together with a side view of the system of the present invention, including the hanger and power cord assembly of FIGS. 1 and 2.

Now referring to FIG. 3, there is shown a ceiling light and fan combination 300 of the present invention shown in a representative environment. Note: while this example shows installation of a fan in a can ceiling light, it should be understood that appliances other than fans can be supported by the apparatus of the present invention, such as additional lighting fixtures, heaters, wireless RF speakers, etc.

Ceiling can light fixture 302 is shown disposed in a ceiling. It should be understood that the system of the present invention can work with suspended or hanging light fixtures or even some wall-mounted light fixtures. Ceiling light female socket 304 is a typical light socket that receives a light bulb screwed therein.

Lamp holder with receptacle 306 is a commercial off-the-shelf electrical adapter which provides a socket to receptacle to socket functionality. It can be used with a pull chain or without, depending upon the specific needs of any particular application. Note that the receptacle in the lamp holder with receptacle 306 is oriented such that the male plug prongs 7 (FIG. 1) are inserted horizontally into the receptacle. Consequently, if a non-lighting ceiling fixture has a similarly oriented receptacle, the present invention could be used by just plugging in the male plug prongs 7 into the receptacle; i.e., there would be no need for the lamp holder with receptacle 306.

Light bulb 308 is shown screwed into the bottom female socket of lamp holder with receptacle 306.

It can be seen that the assembly of FIG. 1 is utilized in combination with a small light-weight fan 310, and the power cord plug head 1 is plugged into the receptacle of the lamp holder with receptacle 306.

The system of the present invention could function as follows:

When a lamp holder with receptacle 306 is used, it is inserted into the ceiling light female socket 304 of a ceiling can light fixture 302 or a suspended ceiling light fixture in lieu of a light bulb. The center of this configuration as shown in FIG. 3 is hereinafter referred to as the vertical centerline. The system of the present invention has a rigid, linear hanger bracket 3 or hanger bracket 3. A standard male electrical plug or power cord plug head 1 equipped with standard wires or power cord 5 is affixed to the top of the hanger bracket 3. The power cord 5 runs alongside the hanger bracket 3. An optional protective jacket 2 can be installed to enclose the hanger bracket 3 and the power cord 5 when required. When the male plug prongs 7 of the power cord plug head 1 are inserted into or "plugged" into the horizontal receptacles of the lamp holder with receptacle 306, two goals are accomplished. First, the male plug prongs 7 obtain electrical power to feed through the power cord 5 to the small light-weight fan 310 or other appliance. Second, the male plug prongs 7 are used in conjunction with and as part of the hanger bracket 3 to safely hold the hanger bracket 3 and its small light-weight fan 310 or appliance in a plugged-in position. The system accomplishes this goal in the following way: First, the hanger bracket 3 descends from the power cord plug head 1. It is shown as positioned to the left side of, and runs parallel to the vertical centerline. (Note: the hanger bracket 3 and the lamp holder with receptacle 306 could be oriented in any direction.) It descends a short distance. Second, the hanger bracket 3 continues to descend, but also bends farther to the left side and away from the vertical centerline. The hanger bracket 3 bends to the left side to provide clearance to allow a light bulb 308 to be inserted into the lamp holder with receptacle 306 light bulb socket. Third, the hanger bracket 3 continues to descend until adequate clearance around the light bulb 308 is attained. At that point, the hanger bracket 3 bends back in the direction of the vertical centerline until it is once again descending parallel to or angled in the direction of the vertical centerline. The hanger bracket 3 continues to descend to a bottom point. At the bottom point, a Leverage Arm is created. The Leverage Arm can be created by bending the hanger bracket 3 at a 90-degree angle in the direction of the vertical centerline or by installing a bolt or rod at the bottom of the hanger bracket 3 extending in the direction of the vertical centerline or by mounting an appliance that acts as a Leverage Arm extending in the direction of the vertical centerline. The Leverage Arm configuration is rigid and extends beyond and to the right side of the vertical centerline to a position that distributes a higher percentage of the weight of the combined appliance and hanger bracket 3 to the right side of the vertical centerline than the weight distributed to the left side of the vertical centerline. This uneven distribution of weight causes downward pressure on the outer end of the Leverage Arm which, in turn, causes the top portion of the hanger bracket 3 to rotate in the direction of the vertical centerline pushing the male plug prongs 7 of the power cord plug head 1 inward and causing them to remain securely plugged in and also safely hold the entire assembly in place. The hanger bracket 3 and power cord plug head 1 combination is designed to pivot around the bottom proximal end of male plug prongs 7, thereby allowing the distal and free ends of male plug prongs 7 to engage structure within the receptacle to enhance retention of the male plug prongs 7 within the receptacle. The beveled face 8 allows the power cord plug head 1 to pivot without causing contact between the top of power cord plug head 1 and the top side of the receptacle, which could tend to force the male plug prongs 7 out of the receptacle. *The use of the terms "left" and "right" are interchangeable and used only to help the reader visualize the device.

Throughout this description, the hanger bracket 3 and power cord 5 are described as separate pieces. However, it should be understood that this may be only one way of making the system. A specially designed single piece of material could form the hanger bracket 3, the power cord 5, and the power cord plug head 1. The design as shown is one that utilizes many off-the-shelf components.

It should also be understood that a special design might also include a specially designed lamp holder with receptacle 306. For example, since the weight of the entire fan is carried by the male plug prongs 7, a specially designed power cord plug head 1 and lamp holder with receptacle 306 might be made which provides for additional non-electrical prongs, or heavier prongs or prongs oriented in directions more suitable for bearing loads.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. A system for adding a fan to a lighting fixture comprising:

an electrical adapter configured to screw into a female light bulb socket around and along a central and substantially vertical axis and provide for an electrical receptacle for receiving therein prongs of a male plug along a substantially horizontal axis, further configured with a displaced light bulb socket to receive therein a light bulb;

a power plug for insertion into and for receiving electrical power from said electrical receptacle;

said power plug having a plug head and a plurality of conductive prongs configured to be received in said electrical receptacle;

each of said plurality of conductive prongs having a distal free end and a proximal end which is substantially rigidly coupled to said plug head;

a member, having a plug end and an opposing appliance end, said member is substantially rigid and is substantially rigidly affixed at said plug end to said plug head;

an electrical appliance coupled to said appliance end of said member;

said member and said electrical appliance in combination configured such that when said plurality of conductive prongs are inserted into said electrical receptacle, all weight of said member and said electrical appliance is supported from above through said power plug, so that mass of said electrical appliance causes said conductive prongs to pivot within said receptacle so that said distal free end of one of said plurality of conductive prong applies a downward force to structure with said electrical receptacle so as to hinder removal of said one of said plurality of conductive prong from said electrical receptacle.

2. The system of claim 1 wherein said electrical appliance is a fan.

3. The system of claim 1 wherein said electrical receptacle is configured to receive therein a standard 110-120 V two-prong power plug.

4. The system of claim 1 wherein said member is curved.

5. The system of claim 1 wherein said plug head has a beveled top side above the plurality of conductive prongs so as to permit pivoting of said plug head with respect to said electrical receptacle without having substantial contact between said receptacle and a portion of said plug head above said plurality of conductive prongs.

6. The system of claim 1 further comprising a threaded elongated member coupling said member with said plug head.

7. The system of claim 1 wherein said member further comprises a plurality of conductors for providing power to said electrical appliance.

8. The system of claim 7 wherein said plurality of conductors are disposed within a separate power cord.

9. A system for hanging a fan from a light bulb socket, comprising:

means for providing power to an electrical receptacle and a displaced light bulb socket through a male adapter configured to screw into a female light bulb socket;

means for transmitting all supporting forces and electrical energy between said electrical receptacle and an electrical appliance disposed below said electrical receptacle; and wherein said means for transmitting all supporting forces and electrical energy is configured to tend to force conductive prongs into said electrical receptacle.

10. A system of claim 9 wherein said means for transmitting all supporting forces and electrical energy is further configured to permit replacement of a flood light bulb into said displaced light bulb socket without disconnecting electrical energy available to said electrical appliance.

11. A system of claim 9 wherein said electrical appliance is a fan.

12. A system of claim 9 wherein all supporting forces are transmitted through two conductive prongs disposed in said electrical receptacle.

13. A system of claim 12 wherein said two conductive prongs are prongs in a standard two-prong 110-120V power plug.

14. A method of hanging a fan from a ceiling light comprising the steps of:

providing an electrical adapter configured to screw into a female light bulb socket around and along a central and substantially vertical axis and further providing an electrical receptacle for receiving therein prongs of a male plug along a substantially horizontal axis, and further being configured with a displaced light bulb socket to receive therein a light bulb;

providing device comprising:

a power plug for insertion into and for receiving electrical power from said electrical receptacle;

said power plug having a plug head and a plurality of conductive prongs configured to be received in said electrical receptacle;

each of said plurality of conductive prongs having a distal free end and a proximal end which is substantially rigidly coupled to said plug head;

a member, having a plug end and an opposing appliance end, said member is substantially rigid and is substantially rigidly affixed at said plug end to said plug head;

an electrical appliance coupled to said appliance end of said member; where said member and said electrical appliance in combination are configured such that when said plurality of conductive prongs are inserted into said electrical receptacle, so that all weight of said member and said electrical appliance is supported from above through said power plug, so that mass of said electrical appliance causes said conductive prongs to pivot within said receptacle, so that said distal free end of one of said plurality of conductive prong applies a downward force to structure with said electrical receptacle so as to hinder removal of said one of said plurality of conductive prong from said electrical receptacle;

grasping said device so as to support all weight of said device and then plugging said power plug into said electrical receptacle;

releasing grasp upon said device so that all support of said device is now being provided from above and through said electrical adapter.

* * * * *